US005302079A

United States Patent [19]

Cestonaro et al.

[11] Patent Number: 5,302,079

[45] Date of Patent: Apr. 12, 1994

[54] APPARATUS AND METHOD FOR ALIGNING PACKAGING BLANKS

[75] Inventors: Jean Cestonaro, Marin; Philippe Brea, Cernier, both of Switzerland

[73] Assignee: Fabriques de Tabac Reunies SA, Neuchatel-Sierrieres, Switzerland

[21] Appl. No.: 80,761

[22] Filed: Jun. 24, 1993

[30] Foreign Application Priority Data

Jul. 6, 1992 [EP] European Pat. Off. ..... 92810517.0

[51] Int. Cl.[5] ..... B65H 29/00

[52] U.S. Cl. ..... 414/788; 414/907; 414/778; 414/783

[58] Field of Search ..... 414/788, 907, 778, 783; 271/146, 241

[56] References Cited

U.S. PATENT DOCUMENTS 4,700,941 10/1987 Shill ..... 271/146 X
5,039,081 8/1991 Shill ..... 414/907 X
5,178,506 1/1993 Meschi ..... 414/788 X

FOREIGN PATENT DOCUMENTS 2224107 12/1973 Fed. Rep. of Germany .
2171814 9/1973 France .
1325288 8/1973 United Kingdom .

*Primary Examiner*—H. Grant Skaggs
*Assistant Examiner*—Carol L. Druzbick
*Attorney, Agent, or Firm*—Kevin B. Osborne; James E. Schardt; Charles E. B. Glenn

[57] ABSTRACT

One or more misaligned packaging blanks or blanks for cigarette boxes in a stack can be realigned by causing the stack to be engaged at both ends by two half-shell-shaped receiving portions. It is then tilted by 90° so that the edges of the blanks all rest on a supporting surface. The two receiving portions are then brought together so as to realign any blanks protruding from the stack longitudinally. A detection device are incorporated in one of the receiving portions for checking the proper orientation of the stack and for causing it to be turned over one way or the other, depending upon its initial orientation.

13 Claims, 4 Drawing Sheets

APPARATUS AND METHOD FOR ALIGNING PACKAGING BLANKS

BACKGROUND OF THE INVENTION

This invention relates to packing equipment, and more particularly to apparatus for aligning packaging blanks, especially blanks for cigarette boxes. This invention also relates to a method utilizing that apparatus for blanks disposed in a stack, and to a cigarette packing machine equipped with such apparatus.

Before they can be processed by a machine for packaging a product, packaging blanks are frequently supplied to the machine in stacks that have been withdrawn from a pallet. U.S. Pat. No. 4,993,915 describes a depalletizer for feeding a cigarette packer with blanks for cigarette boxes. Because of the manipulations and transfers to which each stack of blanks is subjected before arriving at the packing machine, either before or after depalletization, one or more of the blanks in the stack may have shifted slightly relative to the rest of the stack. If precautions are not taken to realign the stack before it is inserted in the packer, the misaligned blank will generally not be accepted by the machine. Instead, it may be bent or even destroyed by jamming, which also usually causes stoppage of the packing line.

Germany (Fed. Rep.) 22 24 107 describes apparatus for aligning packs of blanks which systematically turns over such packs. In Great Britain 1,406,251, the alignment apparatus is chiefly intended to turn over every other pack of labels appearing in reversed directions on a pallet, the labels being supplied one by one to the apparatus. Great Britain 1,325,288 discloses a device more particularly intended to align a covering sheet on a pack that is already aligned.

SUMMARY OF THE INVENTION

It is an object of this invention to provide an improved apparatus and method for aligning packaging blanks which overcomes the aforementioned drawbacks, wherein each stack is seized individually, and misaligned blanks or sheets can be realigned.

Another object of the invention is to provide apparatus and a method whereby transverse alignment of the stack is further facilitated by means of oscillation.

Still another object of the invention is to provide apparatus and a method whereby the orientation of the stack is determined in order to restore all stacks to the same orientation.

To this end, the aligning apparatus according to the present invention comprises two parallel support arms each perpendicular to a longitudinal axis. One end of each arm is provided with means for bringing the arms closer together or moving them apart longitudinally. The other end of each arm is provided with a bearing, and the two bearings are aligned along a longitudinal horizontal axis perpendicular to the two support arms. The apparatus further includes two halfshellshaped receiving portions, each of which includes an end wall, a supporting wall, a top wall, and a bottom wall. The walls are substantially rectangular in shape. The end walls are disposed perpendicularly to the longitudinal horizontal axis. The other walls are fixed perpendicularly to each of three edges of the end wall and define on each half-shell a front opening and a side opening. The two front openings face one another and the two side openings are oriented in the same direction. A pivot is joined perpendicularly, in an approximately central position, to the end wall of each half-shell on the outside thereof, and the pivots are fitted in the bearings on the support arms. Means for rotational actuation is provided in order to cause the two half-shells to pivot synchronously about the horizontal axis. Transport means delivers or discharges a stack of blanks, and presents the stack for engagement by the half-shells, or withdraws it from the half-shells.

According to the aligning method of the present invention, the stack, having one or more misaligned blanks, is delivered by delivering means with the blanks disposed along horizontal planes. Each of the back and front ends of the blanks are positioned by presentation means opposite a front opening of a half-shell-shaped receiving portion, the spacing between the two front openings being greater than the length of the stack. The two half-shells are brought closer together, to a position where a sufficient portion of each end of the underside of the bottom-most blank of the stack is over a surface portion of a bottom wall of each half-shell for the half-shells to support the stack. The presentation means is withdrawn, and the two half-shells, along with the stack of blanks, are pivoted a first time, 90° about a longitudinal horizontal axis. All the blanks of the stack come to rest with a portion of their edges on a support wall disposed in a lower position of each pivoted half-shell, thus aligning any blanks having a transverse misalignment. Portions of the top and bottom faces of the stack which have pivoted to face laterally are held by portions of the top and bottom walls of the half-shells, now pivoted into position as side walls. The two half-shells are brought closer together, and the end walls press longitudinally against the ends of any longitudinally misaligned blanks in order to insert them substantially completely into the stack. The two half-shells, again along with the stack of blanks, are then pivoted a second time, again 90° about the longitudinal horizontal axis. The two half-shells are moved apart to a position in which the stack is accessible for engagement by the conveying means. The presentation means is brought closer until it engages the stack of blanks. The two half-shells are moved apart in order to clear the back and front ends of the stack. The presentation means transfers the stack of aligned blanks to discharging means which discharges it for further processing.

The packing machine according to the present invention, capable of correctly aligning and orienting the stacks of blanks or sheets it receives, is equipped with aligning apparatus as aforesaid.

Although the present specification describes apparatus and a method for aligning blanks or sheets in a stack, it will be understood that this apparatus and method apply equally well to any packaging blanks capable of being processed in the manner described.

BRIEF DESCRIPTION OF THE DRAWINGS

A preferred embodiment of the invention will now be described in detail with reference to the accompanying drawings, in which.

DETAILED DESCRIPTION OF THE INVENTION

Figure 1:
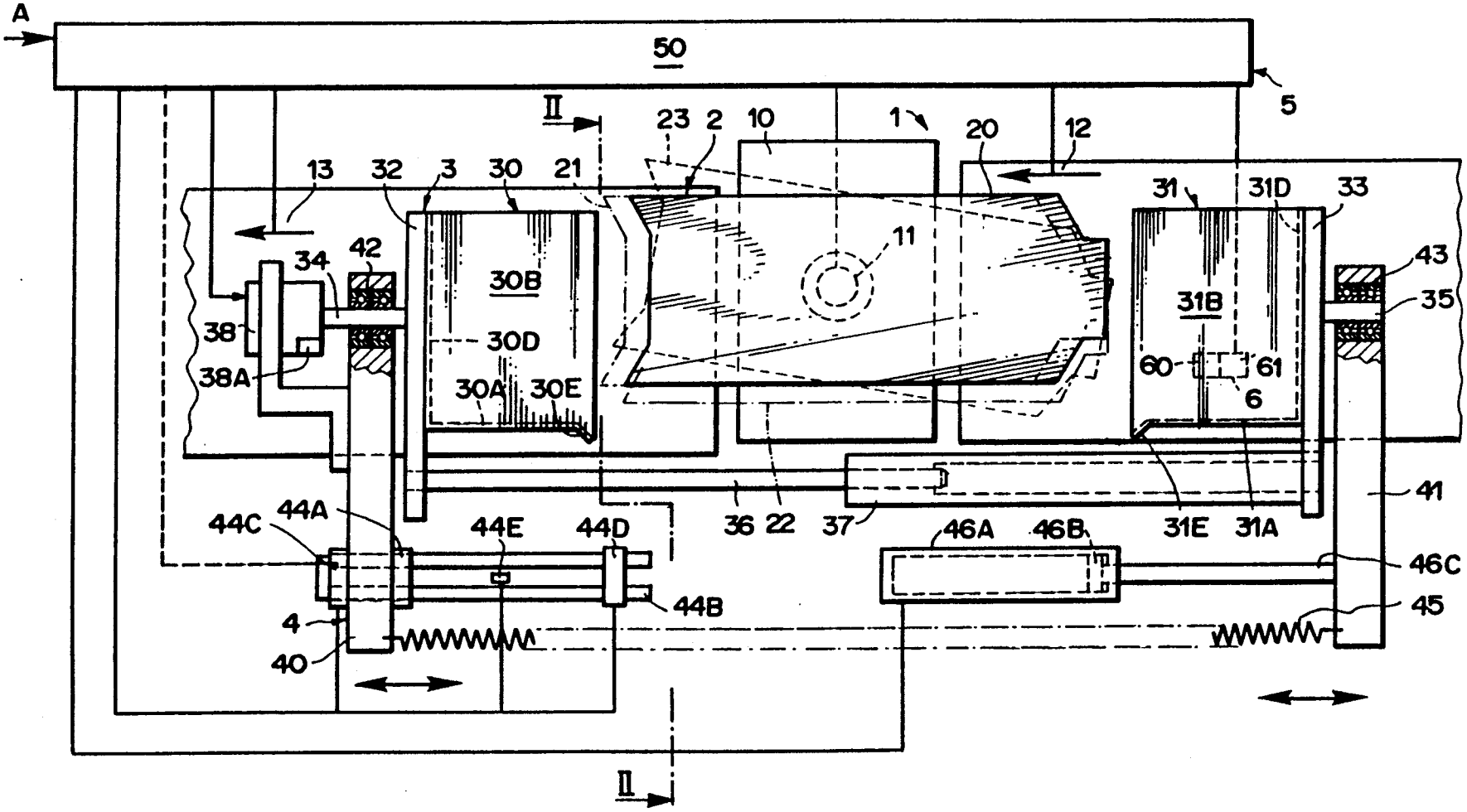
FIG. 1 is a top plan view of part of a packer showing a preferred embodiment of apparatus according to the invention when open.
Figure 2:
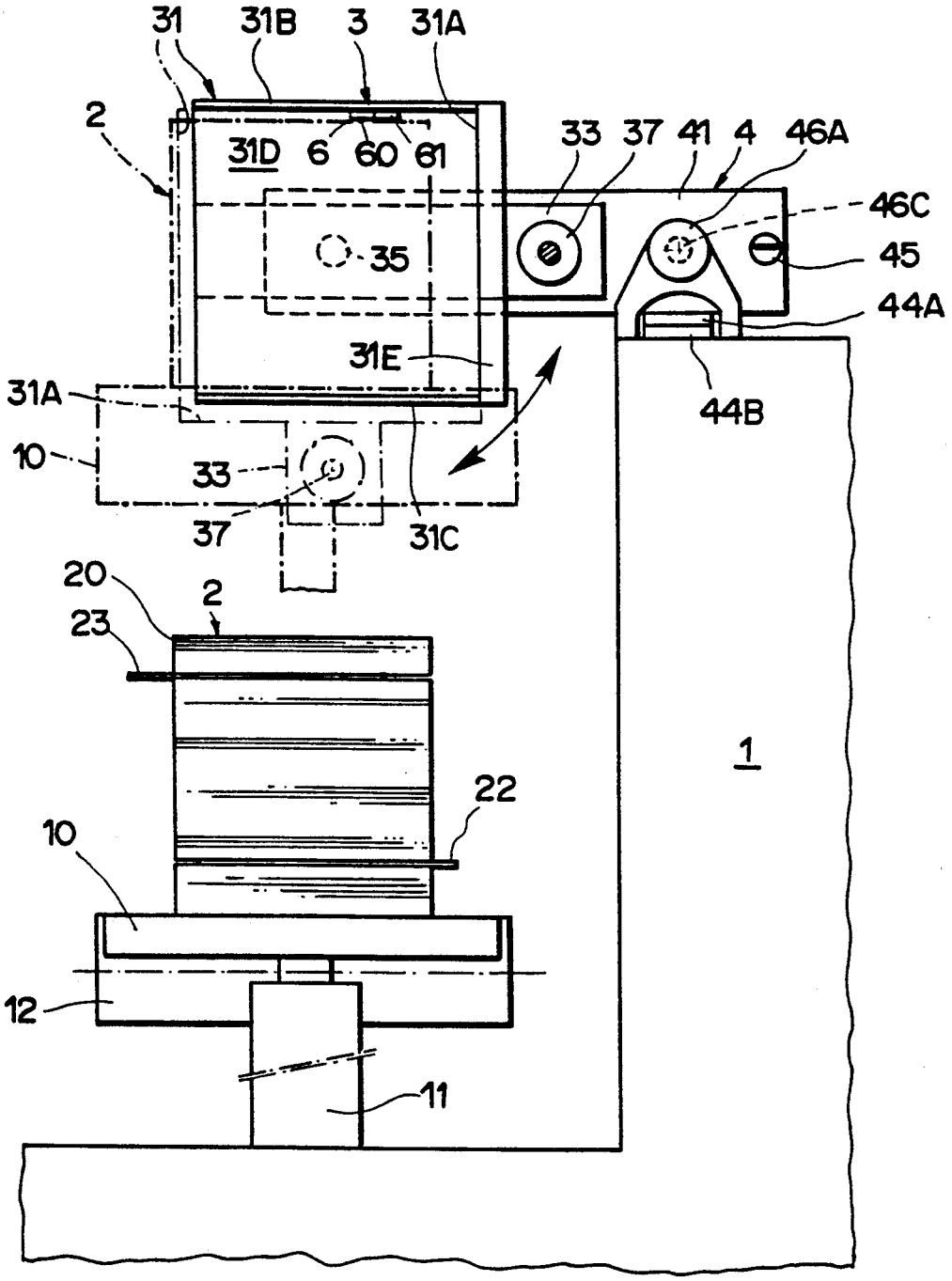
FIG. 2 is a vertical cross-sectional view of the apparatus taken from line II—II of FIG. 1.

FIGS. 1 and 2 show part of a cigarette-packing machine 1 including a preferred embodiment of the invention. A platform 10, when acted upon by a piston 11, can, as shown in FIG. 2, assume either a raised position, as indicated in dotted lines, or a lowered position, as indicated in solid lines. Delivering means 12, e.g., a conveyor belt, brings a stack 2 of blanks 20 for cigarette boxes, e.g., from a depalletizer such as is disclosed in U.S. Pat. No. 4,933,915, to platform 10 when platform 10 is in its lowered position. Stack 2 can also be removed from platform 10 and discharged by discharging means 13 (e.g., a conveyor belt) when platform 10 is in its lowered position. Platform 10 and conveyors 12, 13 collectively form transport means according to the invention.

In order for the blanks to be accepted for the subsequent operations of forming the cigarette box, they must be properly aligned, in the position shown in solid lines for blank 20 in FIG. 1. In fact, however, because of previous handling and transfers, some of the blanks may have shifted, either longitudinally (i.e., in the direction of travel of conveyors 12, 13) or laterally (i.e., transverse to the direction of travel of conveyors 12, 13), as indicated in dot-dash outlines 21 and 22, or may have pivoted at a certain angle, as shown in broken lines at 23. Obviously, both types of shifting may occur in the case of some blanks.

In order to realign the blanks in stack 2, so that they are all arrayed in a certain position, e.g., that represented by blank 20, the apparatus of the invention is preferably composed of a first, pivoting part 3 held by a second, longitudinally displaceable part 4.

Part 4 is preferably made up chiefly of two support arms 40 and 41, preferably disposed horizontally (i.e., parallel to the plane of blank 20 in its position in FIG. 1) and capable of moving longitudinally for a certain distance in order to be brought closer together or moved farther apart by means to be described below.

Pivoting part 3 is preferably made up chiefly of two half-shell-shaped receiving portions 30 and 31, each comprising a supporting wall 30A, 31A, a top wall 30B, 31B, a bottom wall 30C, 31C, and an end wall 30D, 31D. These walls preferably are substantially planar and are disposed perpendicularly to one another, so that each half-shell 30, 31 has the general shape of a rectangular parallelepiped of which two walls have been eliminated. There are no walls on the sides closest to and directly facing stack 2, thus creating a front opening for each half-shell. Similarly, each half-shell 30, 31 is missing the sidewalls which would have been opposite supporting walls 30A, 31A, thus creating respective side openings facing the same direction. Respective end wall 30D, 31D of each half-shell 30, 31 preferably is fixed to a first end of a respective arm 32, 33, which is provided with a respective pivot 34, 35. Each pivot 34, 35 is preferably situated at the center of gravity of each half-shell 30, 31 and pivots in a respective bearing 42, 43 disposed in each of the respective support arms 40 and 41. The respective second ends of pivoting arms 32 and 33 are preferably connected to each other by a sliding device, e.g., a rod 36 sliding within a tube 37, at least part of which has an inner diameter calibrated to the outer diameter of rod 36.

One of the two pivots, e.g., pivot 34, extends beyond the other side of bearing 42 and is connected to a rotational drive means 38. Drive means 38 is preferably a pneumatic actuator that is capable of driving half-shell 30 via pivot 34, and consequently driving half-shell 31 via rod 36 and tube 37, in sequential rotational movements of 90°, as explained below. The body of actuator 38 is fixed to support arm 40. Although actuator 38 is preferably pneumatic, it may be a hydraulically or electrically driven device instead. Moreover, the second half-shell may be driven, instead of via rod 36 and tube 37, by its own actuator, synchronized with actuator 38 and disposed symmetrically therewith.

As stated above, each of the support arms 40 and 41 can be displaced longitudinally over part of packing machine 1 in order to move closer together or farther apart. For this purpose, each arm 40, 41 rests on a slide 44A moving on a track 44B between two stops 44C and 44D, representing the end displacement positions and preferably provided with limit sensors (not shown). Track 44B may also be provided with another sensor 44E signalling a semi-closed position, as explained below. Although a slide and track unit is shown only for support arm 40 in FIG. 1 to avoid clutter in the drawing, it will be understood that support arm 41 is equipped in the same way. As a modification, it would also be possible to have a single track common to both support arms 40 and 41. Similarly, it is possible for only one of support arms 40, 41 to be capable of longitudinal motion, although it would have to have twice the range of motion that each arm would need if both could move.

In order to actuate the displacement of support arms 40 and 41, they are preferably provided with actuating means which may, for example, be a spring 45 drawing arms 40 and 41 together and acting in opposition to a pneumatic or hydraulic device consisting of a jack body 46A fixed to the frame of machine 1 and containing a piston 46B connected by a rod 46C to support arm 41. Although, again to avoid clutter in the drawing, this device is shown in FIG. 1 only for support arm 41, it will be understood that a similar device is preferably disposed symmetrically on support arm 40.

Figure 3:
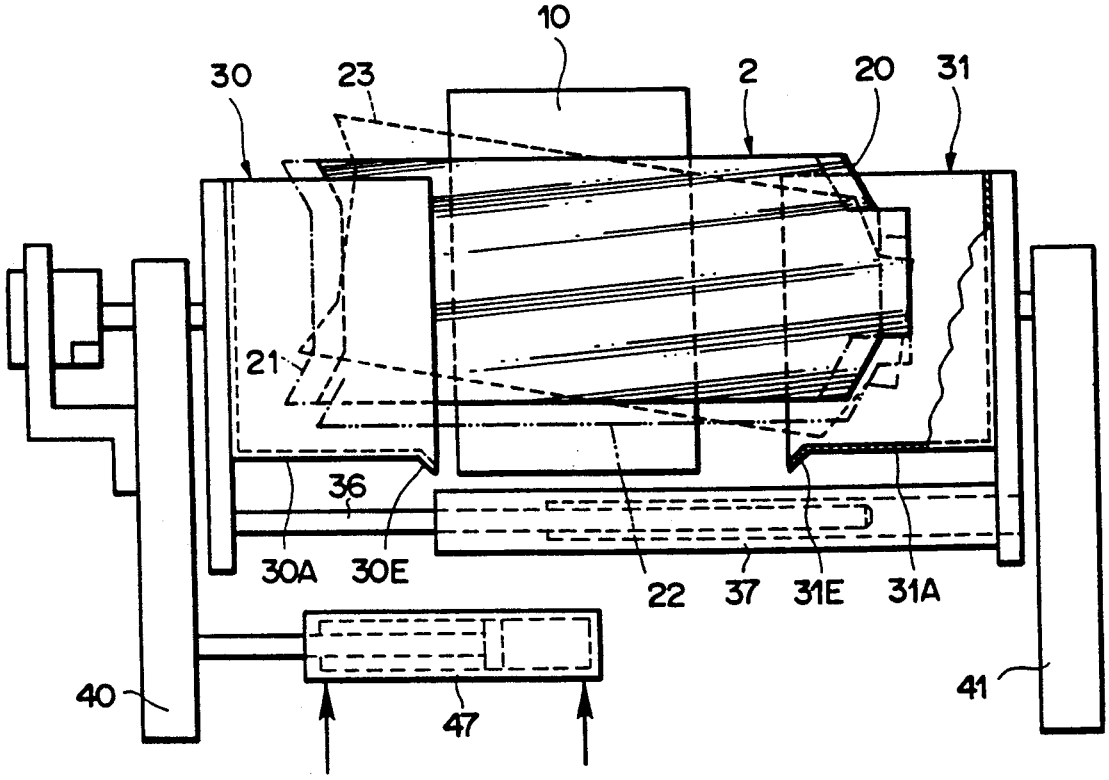
FIG. 3 is a top plan view of the apparatus when half-closed.
Figure 4:
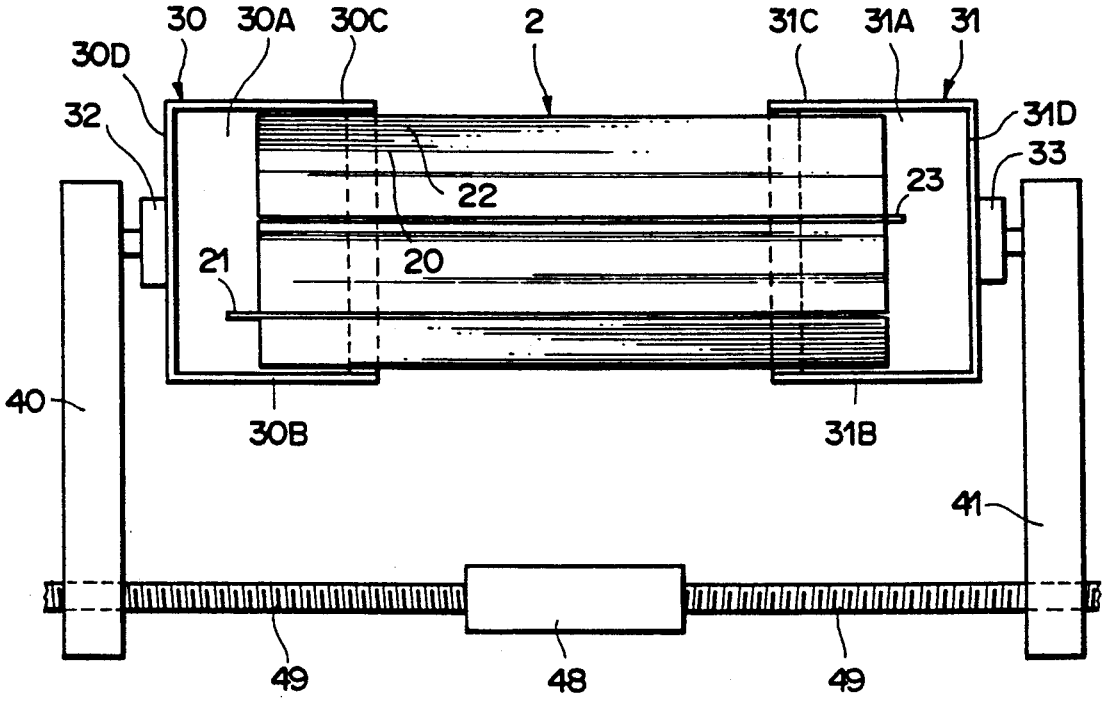
FIG. 4 is an analogous view of the apparatus after pivoting by 90°, and also showing an alternative preferred embodiment of one portion of the apparatus.

Other means may be used to draw arms 40 and 41 together and move them apart. For instance, the actions of spring 45 and jack unit 46A, 46B may be opposite to that described, with the spring forcing the support arms apart while the jack is designed to bring them together. FIG. 3 shows yet another possibility—i.e., the provision of a double-acting pneumatic or hydraulic jack 47, in which case spring 45 may be eliminated. It is also possible to motorize slides 44A directly by electromechanical means or, as illustrated in FIG. 4, to provide a device 48 for rotating a rod 49, the ends of which are oppositely threaded so as to screw in and out of matching threads provided in support arms 40 and 41. In another modification (not shown), one of the support arms is fixed to one length of an endless belt, while the other support arm is fixed to the other length of the same belt; by moving the belt, the arms can be caused to move together or apart.

The method used for realigning a stack 2 of blanks 20, 21, 22, 23 will now be described.

At the start, support arms 40, 41, and thus the two half-shells 30 and 31, are preferably separated from one another to the maximum extent. Half-shells 30 and 31 are turned so that their lateral openings face to the side, i.e., toward the top of FIG. 1 and to the left as viewed (in solid lines) in FIG. 2. Platform 10 is lowered, as shown in solid lines in FIG. 2.

A stack 2, which may include one or more misaligned blanks 21, 22, 23, is brought up by delivering means -- e.g., a conveyor belt 12 disposed at a level such that stack 2 can pass beneath half-shell 31. Conveyor belt 12 stops when the center of stack 2 has arrived approximately in the middle of platform 10, which functions as a presentation means for presenting stack 2 to, and withdrawing it from, half-shells 30, 31. Platform 10 is then raised by means of jack piston 11 so that the underside of the blanks at the bottom of stack 2 is just slightly above the plane defined by the two bottom walls 30C and 31C of half-shells 30 and 31. These half-shells are then moved toward one another, by the longitudinal displacement means of support arms 40 and 41 described above, to an intermediate or semi-closed position, as shown in FIG. 3.

As may be seen in FIGS. 1, 2, and 3, the horizontal axis along which stack 2 is conveyed by conveyor belt 12 is offset laterally with respect to the horizontal axis including the center of gravity of half-shells 30 and 31, corresponding approximately to the axis connecting pivots 34 and 35. This distance between the two horizontal axes is at least equal to, and preferably corresponds to, the preferred maximum permissible extent of a lateral shift of a blank 22 in stack 2; for at the time of the movement of half-shells 30 and 31 toward one another as described above, it is preferable that no part of the blanks in stack 2 should come in contact with any part of half-shells 30 and 31. To achieve this, the distance separating the two inside faces of top and bottom walls 30B, 30C and 31B, 31C is preferably slightly greater than the height of stack 2. As may be seen in the drawings, the edge of each supporting wall 30A, 31A closest to the other supporting wall 31A, 30A may include a flared lead-in 30E, 31E to facilitate the insertion of a blank having a misalignment that is very close to, or even slightly greater than, the preferred maximum permissible misalignment.

When the back and front ends of stack 2 have been inserted into half-shells 30 and 31 far enough for bottom walls 30C and 31C to support stack 2, which position can be signalled by sensor 44E, the movement if half-shells 30, 31 toward each other is stopped. Platform 10 is then lowered in order to clear the space remaining between the two half-shells 30, 31. The ends of stack 2 then rest on bottom walls 30C and 31C, as shown in FIG. 3.

Pivoting part 3, i.e., half-shells 30 and 31 containing stack 2, then pivots by 90° about its longitudinal horizontal axis, driven by actuator 38 as explained above, so that supporting walls 30A and 31A come into the bottom position, as shown in FIG. 4 or as indicated by a dot-dash line in FIG. 2. Blanks 20, seen from above in FIG. 4, are therefore caused by the force of gravity to drop onto their bottom edges against supporting walls 30A and 31A. Inasmuch as lateral play exists between the blanks as a result of the difference between the height of stack 2 and the distance between the top and bottom walls 30B, 31B and 30C, 31C of each half-shell 30, 31, which walls are now disposed laterally with respect to stack 2, this drop can take place freely. As a result of this operation, blanks 22 and 23, which were out of alignment transversely, become correctly realigned with respect to stack 2.

Figure 5:
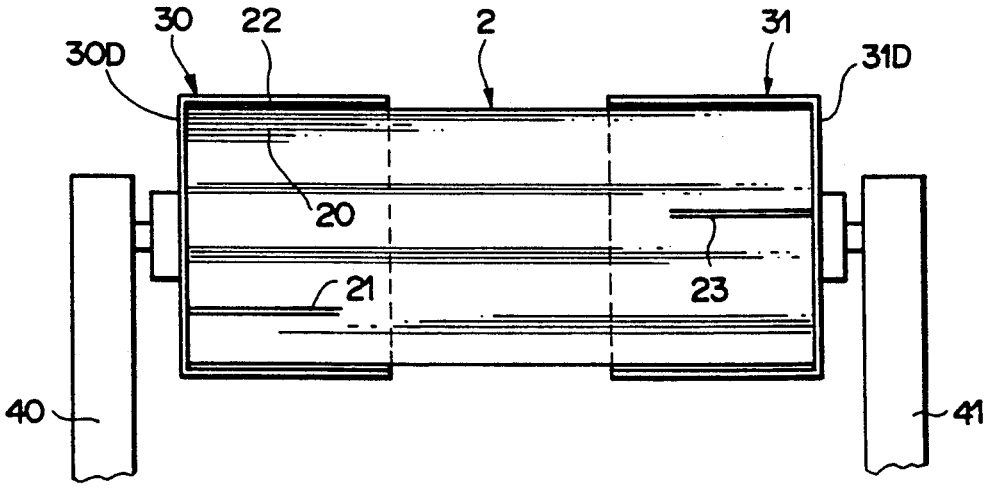
FIG. 5 is a top plan view of the apparatus, in the orientation of FIG. 4, when closed.

The longitudinal displacement of half-shells 30 and 31 toward one another by means of support arms 40 and 41 is then resumed until the half-shells are in the closed position illustrated in FIG. 5. This movement is effected without further pivoting. As a result of this closing movement, end walls 30D and 31D push the ends of longitudinally misaligned blanks 21 and 23 until they are substantially completely reintegrated into stack 2. As explained above, since the blanks are not pressed against one another, this realignment takes place easily, with the misaligned blanks sliding into stack 2 with little frictional resistance. The closing movement is stopped at the moment when the distance between end walls 30D and 31D just exceeds than the length of a blank 20 by a distance equal to or less than the maximum permissible longitudinal misalignment of stack 2 for further processing by the packing machine. After this operation, each blank 20 is correctly aligned in stack 2.

Half-shells 30 and 31 are then pivoted by 90° once more and separated as far as the position shown in FIG. 3. Platform 10 is again raised until it comes in contact with the underside of the bottom blank in stack 2 and lifts the bottom of stack 2 slightly off the walls of half-shells 30 and 31. Half-shells 30 and 31 are then moved apart, preferably completely apart, so that they are totally disengaged from stack 2. Stack 2 is then lowered by means of platform 10 and piston 11 to the level of the discharging means, e.g., conveyor belt 13, which can then carry the correctly aligned stack 2 to the next processing step in packing machine 1. It will be noted in FIG. 1 that conveyor belt 13, used for discharging, is shifted laterally with respect to conveyor belt 12, used for delivery, because, as explained above, stack 2 moved vertically when it was aligned on the bottom edges of the blanks while pivoted. When stack 2 is pivoted back to its original position, that vertical movement translates into horizontal displacement.

The apparatus as a whole, and the various movements described above, are controlled by a control unit 5 (FIG. 1) comprising a central unit 50, which is in turn controlled by the overall control system (indicated by arrow A in FIG. 1) of the packing machine, and acting on the various drives of the apparatus. In order to limit the extent of these movements and to monitor them, sensors may disposed on stops 44C and 44D. Similarly, one or more sensors 38A may be disposed on actuator 38, and a position sensor 44E may be disposed on track 44B.

Blanks 20 usually have one face printed, while the other face bears no printing. It may happen during previous handling that some stacks of blanks are inadvertently turned over completely—i.e., if the stacks should normally come into the cigarette packer with the printed face up, there may from time to time be a stack having the printed face down. Since the stack is in any case twice pivoted by 90° about its longitudinal axis during the method described above, the total pivoting by 180° can be used to correct this situation. A sensor device 6 may be incorporated on the inside surface of either the top or bottom wall of one of the half-shells, e.g., top wall 31B of half-shell 31. Device 6 preferably includes a transmitter 60 and a receiver 61, preferably disposed in a single case (see FIGS. 1 and 2). Transmitter 60 preferably emits a beam of light directed toward stack 2, while receiver 61 is a sensor adapted to receive light. The intensity of the light reflected back to sensor 61 by a surface of the nearby blank will vary depending upon whether that surface is printed or not. The signal thus produced is then supplied to central control unit 50 which, after the blanks in a stack 2 have all been aligned as described earlier, orders pivoting part 3 to pivot, according to the intensity of the signal received, either back to its starting position if the stack 2 is correctly oriented, or on for another 90° so that stack 2 is either face up or face down as required, and is properly oriented for the remaining processing of the blanks.

In order to improve the aligning of the stack, an oscillatory motion can be applied to the stack during the alignment procedure. The oscillatory motion may be supplied in any known manner. For example, piston 11 or the actuating means for support arms 40, 41 can be given oscillatory motion components to impart vertical or horizontal oscillation, respectively. Both modes of oscillation could also be imparted if desired, and other means for imparting oscillation can be used.

Whereas the foregoing description pertains to blanks having a particular shape, as illustrated in the drawings, the inventive apparatus and method may obviously also be applied to blanks having different shapes or sizes. It is preferred, however, that at least one edge of the blanks be straight, i.e., that one face of the stack constituting the edges of these blanks be planar, in order for them to be aligned as described. It is necessary that at the very least the edge of the blanks have a configuration that will always come to rest in one stable position—e.g., a straight edge with two protrusions relatively far apart from each other (other such edge configurations are possible). Furthermore, it may not be absolutely necessary for the stack to be aligned along the two perpendicular directions indicated. Depending on the configuration of the stack, it may be sufficient to align the blanks transversely, solely by the force of gravity after pivoting, or else longitudinally, by the pressure of the end walls against two end faces of the stack.

Although a preferred embodiment of the alignment apparatus has been described, other designs may clearly be envisaged; in particular, support arms 40 and 41 need not be horizontal but may be disposed obliquely or vertically instead. Those skilled in the art will be capable of designing slides and tracks 44A and 44B so that the apparatus nevertheless does not tilt. Nor is it absolutely necessary for the walls of the half-shells to be solid as shown in the drawings; they may equally well be perforated. Moreover, the means for conveying the stacks have been described as consisting particularly of two conveyor belts respectively delivering and discharging the stacks of blanks along a route parallel to the longitudinal axis of the stacks; it is just as conceivable to provide apparatus in which the stacks are delivered and/or discharged along a route perpendicular to that axis. Similar operation of the apparatus may also be envisaged with other conveying means, e.g., a clamp gripping the stack to be aligned.

The inventive apparatus and method are intended to provide an easy means of achieving the proposed objects; viz., to realign rapidly and efficiently such blanks as are out of alignment, as well as to reorient a stack which is wrongly oriented. Another advantage of the apparatus is that, in view of its relatively simple design and compact size, it is quite possible to integrate it into an existing packer, considerably improving its output while reducing downtime caused by jammed blanks.

One skilled in the art will appreciate that the present invention may be practiced by other than the described embodiments, which are presented for purposes of illustration and not of limitation, and the present invention is limited only by the claims which follow.

What is claimed is:

1. Apparatus for aligning packaging blanks, especially for cigarette boxes, comprising:

two parallel support arms, each perpendicular to a longitudinal axis;

means for bringing said arms closer together and for moving them apart longitudinally;

two bearings, each bearing respectively disposed on one of said arms, said two bearings being aligned along a longitudinal horizontal axis perpendicular to said two arms;

two half-shell-shaped receiving portions, each including an end wall, a supporting wall, a top wall, and a bottom wall, each said wall being of substantially rectangular shape, each said end wall being disposed perpendicular to said longitudinal horizontal axis and each other said wall being fixed perpendicularly to a respective edge of said end wall and defining on each said receiving portion a front opening and a side opening, said two front openings facing one another and said two side openings being oriented in the same direction;

a respective pivot joined perpendicularly in a substantially central position to each said end wall thereof, each said pivot being fitted in a respective one of said bearings;

actuation means for causing said receiving portions to pivot synchronously about said longitudinal horizontal axis; and transport means, including means for delivering, and means for discharging, a stack of packaging blanks to be engaged by and withdrawn from said receiving portions, and further including presentation means for accepting said stack from said delivery means and presenting said stack to said receiving portions.

2. The apparatus of claim 1 wherein:

said means for bringing said arms closer together and for moving them apart longitudinally comprises a respective means respectively disposed at, and acting on, one end of each of said arms; and each of said bearings is disposed at the respective other end of each of said arms.

3. The apparatus of claim 1 wherein said presentation means is further for withdrawing said stack from said receiving portions, and presenting said stack to said discharging means.

4. The apparatus of claim 1, wherein the longitudinal axis of said stack on said delivering means is offset transversely relative to the longitudinal horizontal pivoting axis toward said side opening of each receiving portion by a distance at least equal to that of a maximum permissible lateral misalignment of a blank in a said stack.

5. The apparatus of claim 4, wherein at least one said wall of each said receiving portion includes a flared lead-in portion oriented away from said horizontal pivoting axis of said receiving portion and disposed on an edge of said wall closest to the other said receiving portion.

6. The apparatus of claim 1, wherein said actuation means comprises:

a single actuator driving said respective pivot joined to a first said receiving portion;

a first pivoting arm joined to said end wall of said second receiving portion;

a second pivoting arm fixed to said end wall of said first receiving portion for driving the second said receiving portion; and an extendable and retractable coupling connecting said first and second pivoting arms.

7. The apparatus of claim 1, wherein said actuation means imparts an oscillatory motion to said stack standing on edge.

8. The apparatus of claim 1, further comprising means for detecting an orientation of said stack and for supplying a signal controlling the direction of pivoting of said stack.

9. The apparatus of claim 1, further comprising a plurality of sensors and a control unit capable of receiving signals from said sensors and of controlling longitudinal displacements and pivoting movements of each said receiving portion responsive to said signals.

10. A method of aligning packaging blanks, especially blanks for forming cigarette boxes disposed in a stack, comprising the steps of:

bringing up the stack having one or more misaligned blanks by transport means, the blanks being disposed along horizontal planes, in order to dispose each of back and front ends of the blanks opposite a front opening of a respective one of two half-shell-shaped receiving portions, a spacing between the two front openings being greater than a length of the stack;

bringing the two receiving portions closer together up to a position where a portion of each end of an underside of a blank disposed at a bottom of the stack is over a surface portion of a bottom wall of each receiving portion;

withdrawing the transport means;

pivoting the two receiving portions, hence the stack of blanks, by 90° about a longitudinal horizontal axis, all the blanks of the stack coming to rest on a portion of their edges on a support wall disposed in a lower position of each pivoted receiving portion, thus aligning the blanks having a transverse misalignment, portions of top and bottom faces of the stack which have pivoted to face laterally being held by portions of top and bottom walls of the receiving portions;

bringing the two receiving portions closer together, end walls of the two receiving portions thereof pressing longitudinally against ends of misaligned blanks in order to insert them substantially completely into the stack;

pivoting the two receiving portions, hence the stack of blanks, by 90° about the longitudinal horizontal axis a second time;

moving the two receiving portions apart up to a position in which the stack is accessible for being engaged by the transport means;

bringing the transport means closer until it engages the stack of blanks;

moving the two receiving portions apart in order to free the ends of the stack therefrom; and discharging the stack of aligned blanks by the transport means for further processing.

11. The method of claim 10, further comprising the step of applying an oscillatory motion to the receiving portions, hence to the stack of blanks, when the blanks are resting on their edges.

12. The method of claim 10, comprising the further steps of;

detecting an orientation of the stack of blanks and generating a signal representing said orientation; and according to said signal, selecting a direction for pivoting said receiving portion by 90° said second time so that the stack is oriented in a desired orientation.

13. A packing machine for cigarettes equipped with apparatus for aligning packaging blanks for cigarette boxes, said apparatus comprising:

two parallel support arms, each perpendicular to a longitudinal axis;

means respectively disposed at one end of each of said arms for bringing said arms closer together and for moving them apart longitudinally;

two bearings, each bearing respectively disposed at the respective other end of each of said arms, said two bearings being aligned along a longitudinal horizontal axis perpendicular to said two arms;

two half-shell-shaped receiving portions, each including an end wall, a supporting wall, a top wall, and a bottom wall, each said wall being of substantially rectangular shape, each said end wall being disposed perpendicular to said longitudinal horizontal axis and each other said wall being fixed perpendicularly to a respective edge of said end wall and defining on each said receiving portion a front opening and a side opening, said two front openings facing one another and said two side openings being oriented in the same direction;

a pivot joined perpendicularly in a substantially central position to each said end wall thereof, each said pivot being fitted in a respective one of said bearings;

actuation means for causing said receiving portions to pivot synchronously about said longitudinal horizontal axis; and transport means, including means for delivering, and means for discharging, a stack of packaging blanks to be engaged by and withdrawn from said receiving portions, and further including presentation means for accepting said stack from said delivery means, presenting said stack to said receiving portions, withdrawing said stack from said receiving portions, and presenting said stack to said discharging means.

* * * * *